United States Patent [19]

Wirz

[11] 4,378,734

[45] Apr. 5, 1983

[54] SHEET TRANSFER CYLINDER FOR SHEET-FED ROTARY PRINTING MACHINES CONVERTIBLE BETWEEN FIRST FORM AND PERFECTOR PRINTING

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 305,513

[22] Filed: Sep. 25, 1981

[30] Foreign Application Priority Data

Sep. 30, 1980 [DE] Fed. Rep. of Germany ..... 3036790

[51] Int. Cl.[3] ..... B41F 5/02; B41F 21/04; B41F 21/08; B41F 5/22

[52] U.S. Cl. ..... 101/230; 101/410

[58] Field of Search ..... 101/230, 231, 183, 410, 101/411, 246, 409; 271/184, 185, 186, 69, 277, 82, 225, DIG. 9; 355/23, 24

[56] References Cited

U.S. PATENT DOCUMENTS 3,096,088 7/1963 Young ..... 271/277
4,024,814 5/1977 Becker ..... 101/410

FOREIGN PATENT DOCUMENTS 1155145 10/1963 Fed. Rep. of Germany ..... 101/410
2449122 10/1975 Fed. Rep. of Germany ..... 101/230

*Primary Examiner*—J. Reed Fisher
*Attorney, Agent, or Firm*—Herbert L. Lerner; Laurence A. Greenberg

[57] ABSTRACT

Sheet transfer cylinder for a sheet-fed rotary printing machine convertible between first form and perfector printing having a gripper device for gripping the leading edge of a sheet and a suction device for gripping the trailing edge of the sheet and tightening and smoothing the sheet in travel direction thereof through the machine and transversely to the travel direction including first control means including at least one circumferential cam for controlling circumferential sheet-tightening movement, second control means including lateral cams for controlling lateral sheet-tightening movement, the suction device having parts thereof disposed side-by-side in axial direction of the cylinder and formed with suction holes, and transmission means operatively connecting the first and the second control means with the parts of the suction device so as to superimpose actions thereon for applying a diagonal tightening force to the sheet, the first and the second control means being independent of one another.

10 Claims, 13 Drawing Figures

SHEET TRANSFER CYLINDER FOR SHEET-FED ROTARY PRINTING MACHINES CONVERTIBLE BETWEEN FIRST FORM AND PERFECTOR PRINTING

The invention relates to a sheet transfer cylinder for a sheet-fed rotary printing machine convertible between first form and perfector printing, and wherein, more particularly, the cylinder has a gripper device for gripping the leading edge of a sheet and a suction device for gripping the trailing edge of a sheet and which tighten or tension the sheet in travel direction thereof through the machine and transversely thereto, and smooth the sheet.

The purpose of such a construction is to prevent deformations and ensure gentle transfer of the trailing edge of the sheet. Such a sheet tightening or tensioning action furthermore has the purpose of permitting exact transfer of the trailing sheet edge in perfector printing so as to ensure maintenance of the sheet in register, both in circumferential and axial or lateral directions.

A device of the foregoing general type is known from German Pat. No. 24 52 096. Defined therein is a suction system formed of a plurality of turning suction feet or suckers having suction faces with eccentrically disposed suction openings lying in the periphery of the transfer cylinder, the suction feet being turned for pulling tight the trailing sheet edge. In this system, the component of the tightening or tensioning motion extending in the circumferential direction of the sheet transfer cylinder is not along a circumferential line of the drum but, in fact, the direction of motion of the rotary sucker actually lies on a tangent to the sheet transfer cylinder. Because, furthermore, the suction holes are at different distances from the middle point of the rotary sucker, different suction levels are produced at different distances from the middle point of the sheet transfer cylinder, which especially in the case of thin papers may cause tensioning of the sheet being transported.

A further system with which tightening or tensioning of a sheet in travel direction thereof and transversely thereto is effected is described in German Pat. No. 1 155 145 using suction heads provided with a pretensioning device which, in part, are disposed at an angle to the travel direction of the sheet. Such a system, however, only provides the desired outcome, if the tensioning or tightening motion of all of the suction heads takes place at the same time and with the same effect. This is, however, not possible because small differences always present in the resistance of the springs in the suction heads and in the different sealing effects caused by the layout of the paper sucked up against the suction head on the suction holes and, furthermore, uneven thickness of the paper, are responsible for uneven tightening or tensioning of the sheet, which is responsible for creasing. For this reason, this last-mentioned, heretofore known system has not proven successful in the printing trade. The known system, furthermore, requires a relatively high suction action for forcing together the springs in the suction heads. Because of this high suction force, damage to the paper, more specifically thin paper, is likely. In the case of both heretofore known systems mentioned hereinbefore, there is, furthermore, in all cases a connection in function between the axial or lateral and the circumferentially directed tensioning or tightening travel path, something which does not meet the different conditions which have to be produced on processing narrow and broad webs of paper so that the paper is not pulled tight and smoothened at the trailing edge thereof.

Starting out from the state of the art of such prior art systems, it is an object of the invention of the instant application to provide a device for tightening or tensioning and smoothing the sheet in the direction of motion thereof and transversely thereto, which avoids the shortcomings noted hereinbefore and, more specially ensures gentle handling of the sheet to be tightened or tensioned. A further object of the invention is to provide such a device which counteracts the difficulties which arise when processing narrow or broad web paper.

With the foregoing and other objects in view, there is provided, in accordance with the invention, a sheet transfer cylinder for a sheet-fed rotary printing machine convertible between first form and perfector printing having a gripper device for gripping the leading edge of a sheet and a suction device for gripping the trailing edge of the sheet and tightening and smoothing the sheet in travel direction thereof through the machine and transversely to the travel direction comprising first control means including at least one circumferential cam for controlling circumferential sheet-tightening movement, second control means including lateral cams for controlling lateral sheet-tightening movement, the suction device having parts thereof disposed side-by-side in axial direction of the cylinder and formed with suction holes, and transmission means operatively connecting the first and the second control means with the parts of the suction device so as to superimpose actions thereon for applying a diagonal tightening force to the sheet, the first and the second control means being independent of one another.

It is thereby possible, especially, to adjust the axial or lateral tightening or tensioning of the paper sheet or furthermore effect the adjustment separately from and without having any effect upon the circumferential tightening or tensioning. Even if the lateral tightening path along which the individual suction hole groups or fields are moved is different, it is nevertheless possible to ensure that the travel path in the circumferential direction (for pulling the paper tight) by the groups or fields of suction holes is kept constant over the full breadth of the sheet. The fact that the pulling operation takes place evenly and with a uniform tightening or tensioning operation furthermore ensures gentle treatment of the paper sheet at all times. The hereinafter defined embodiments of the invention, are also suited in an especially advantageous manner for use with thin and soft papers, in which respect then, additional narrow printing on the paper is prevented. The possibility of using a very great number of suction holes increases the functional reliability of the suction device at high machine speeds. The provided sheet tightening or tensioning in or approximately in the cylinder radius prevents deformation or creasing of the sheet.

In accordance with another feature of the invention, the lateral sheet-tightening movement is over a given travel path, the travel path being adjustable.

In accordance with a further feature of the invention, the suction device comprises a plurality of suction units including the parts thereof, a plurality of the suction holes as well as suction channels being formed in each of the suction units.

In accordance with an additional feature of the invention, there is provided a shaft for the transfer cylinder whereon sheet supporting segments of the transfer cylinder are adjustably mounted, and further including pipes disposed parallel to the transfer cylinder shaft and turningly supported in respective rear segments of the sheet supporting segments, the suction unit parts including respective suction levers mounted side-by-side on the pipes, spring-loaded cam follower means cooperatively engaging the circumferential cam and actuatable thereby for imparting circumferential motion to the suction levers, and cam follower rollers secured to respective ends of the pipes and cooperatively engaging the lateral cams and actuatable thereby for imparting transverse tightening motion thereto, the lateral cams being fixed to side frame walls of the printing machine.

In accordance with an added feature of the invention, the transfer cylinder has a middle transverse axis and there are provided spring means disposed at the middle transverse axis between the pipes for biasing the pipes in mutually opposite directions and for moving the respective suction levers fixed to the respective pipes in opposite directions towards the closest-lying outer edge of the sheet transfer cylinder, the movement thereof being over a given travel path, and including adjustment screw means for adjusting the travel path.

In accordance with yet another feature of the invention, there is provided a rod extending over the entire length of the transfer cylinder, two casing pipes mounted on the rod coaxially thereto, the suction units including respective suction levers mounted on the casing pipes and fixed thereon against relative rotation therewith, the pipes, in turn, being fixed on the rod against relative rotation therewith but being axially displaceable relative thereto, the casing pipes being spring-biased so as to be axially displaceable in mutually opposite directions, and including adjustably mounted sheet supporting segments, respective rear segments thereof carrying respective cam plates disposed at an adjusting angle adjustable by adjusting screws, the casing pipes having respective push rods extending therefrom and slideable along the cam plates when being moved with circumferential swinging movement.

In accordance with yet a further feature of the invention, the suction levers are circumferentially movable by the rod, and there are provided spring-loaded roller follower means guidable on the circumferential cam, and key means for preventing relative torsion of the rod and the casing pipes.

In accordance with yet an additional feature of the invention, there is provided a pipe extending along the entire length of the transfer cylinder, the suction units including suction levers mounted on the pipe and fixed thereon against relative rotation therewith, the suction levers having respective upper regions engageable with a sheet to be pulled tight, respective suction plates disposed at the upper regions, respectively, the suction plates being longitudinally movable on the suction levers, respectively, and being exchangeable.

In accordance with yet an added feature of the invention, there are provided cam plates disposed at an adjusting angle adjustable by adjusting screws, push-rod means engageable with the cam plates individually for acting directly upon the respective suction plates for controlling the lateral sheet-tightening movement with infinite adjustment.

In accordance with a concomitant feature of the invention, there are provided a plurality of adjustably mounted sheet supporting segments, the suction holes being formed directly in respective rear segments thereof, the outer radius of turning of the suction device corresponding to the radius of the sheet transfer cylinder, and including two suction supply pipes respectively connecting the plurality of sheet supporting segments.

Other features which are considered as characteristic for the invention are set forth in the appended claims.

Although the invention is illustrated and described herein as embodied in a sheet transfer cylinder for sheet-fed rotary printing machines convertible between first form and perfector printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
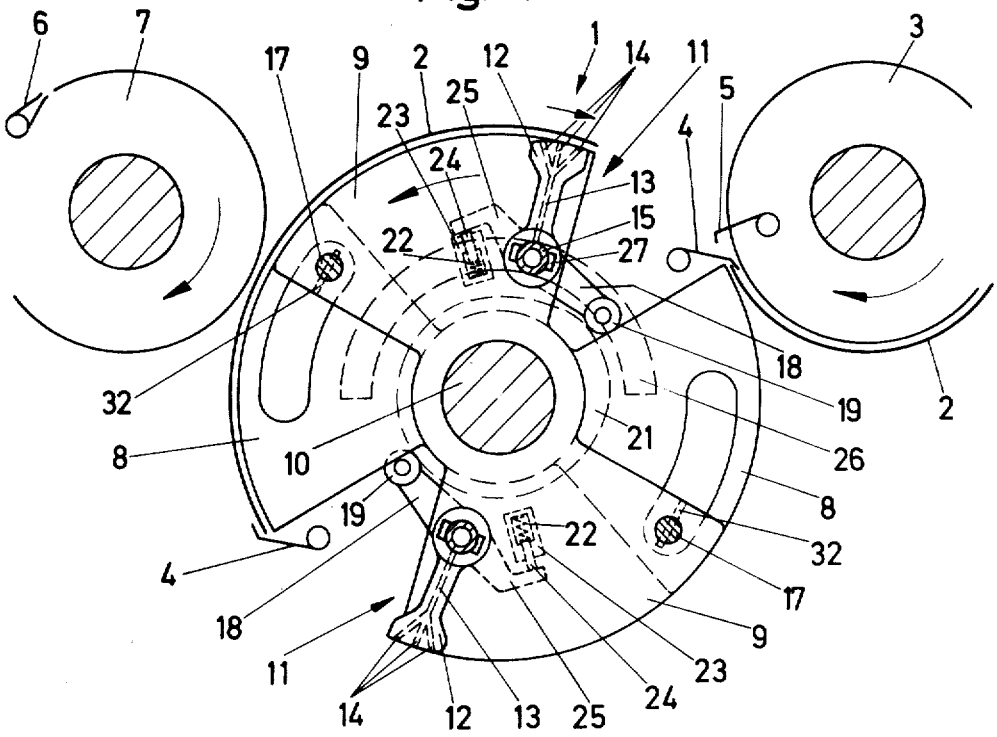
FIG. 1 is an end view of a sheet transfer cylinder having suction levers, together with a device for controlling circumferential movement pulling a sheet tight.
Figure 2:
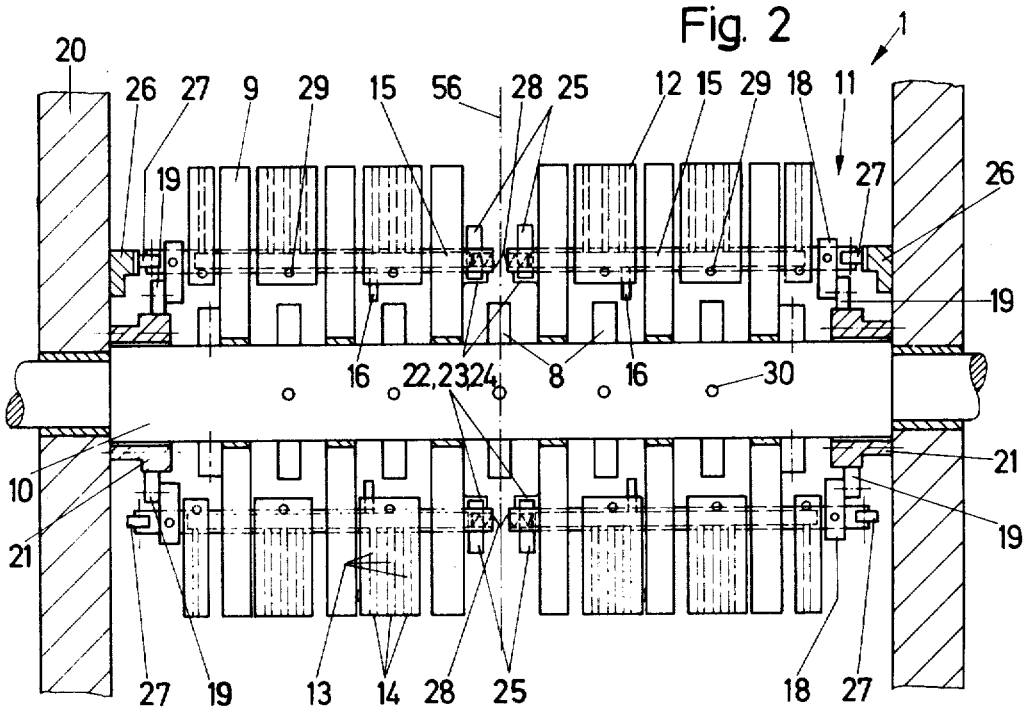
FIG. 2 is a side view of the transfer cylinder of FIG. 1 with a device for controlling the tightening or tensioning of a sheet in lateral or axial direction.

Referring now to the drawing and first, particularly, to FIGS. 1 and 2, there is shown therein an embodiment of the invention including a sheet transfer cylinder 1, to which a sheet 2 of paper is fed from a transfer cylinder 3. This is accomplished in a conventional manner by means of grippers 4 and 5 provided therefor on the two cylinders 1 and 3. Whereas, in the case of first form or single-side printing, the sheet 2 is surrendered by the grippers 4 of the sheet transfer cylinder 1 to the grippers 6 of the turning or perfecting cylinder 7, in the case of perfector printing, an edge of the sheet is initially taken up by the perfecting cylinder 7 so that the sheet 2 may then, after being turned, be fed to the next printing unit. The circumference of the sheet transfer cylinder 1 is equal to twice the circumference of the transfer cylinder 3 and the perfecting cylinder 7, respectively.

The sheet transfer cylinder 1 is formed of individual sheet-guiding or supporting segments 8 and 9, respectively, which are turnable relative to one another about the shaft 10 of the cylinder 1. For this purpose, the rear sheet guiding segments 9 are mounted so as to be turnable about the shaft 10. Matching of the sheet-supporting casing surface to different sheet sizes to be processed is thereby assured.

The trailing edge of the sheet is gripped by a suction device 11 which is formed of individual suction levers 12 formed with suction holes 13 branching into several channels 14. The suction levers 12 are, respectively, keyed on two pipes 15 i.e. fixed against turning relative thereto, which are parallel to the shaft 10 of the cylinder 1 and are mounted in the rear sheet-guiding segments 9. Through these pipes 15, suction is supplied also via suction connections or unions 16 (FIG. 2) and otherwise non-illustrated control valves. The rear sheet-guiding segments 9 are joined together by two cross-pieces 17. Swinging or swiveling motion of the suction levers 12 is effected by spring-loaded roller followers or levers 18 with rollers 19 and respective circumferential i.e. radially acting, cams 21 attached to side walls 20 of the frame of the printing machine. The spring 22 for driving each follower 18 is braced, via a push rod or plunger 24 against a stop 23 fixed to the rear sheet-guiding segment 9 and, via a lever 25 fixed to each pipe 15, forces the roller followers 18 against the radially-action or circumferential cam 21.

Figure 4:
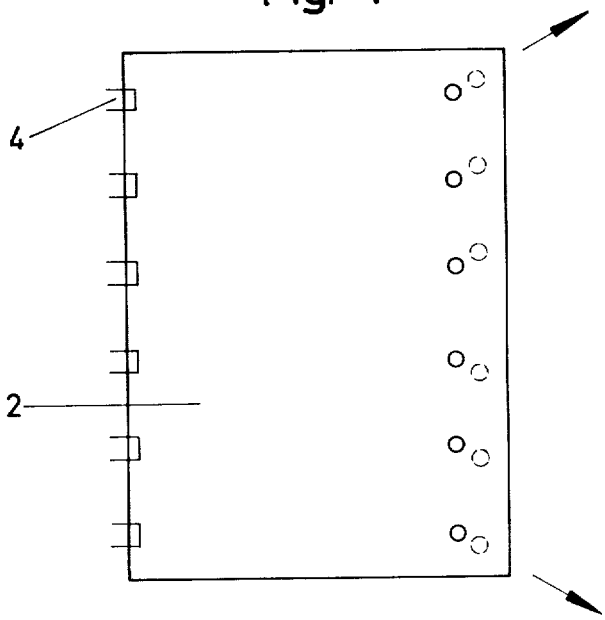
FIG. 4 is a plan view of a sheet being pulled tight with the device of FIGS. 1 to 3.

As is clearly seen in FIG. 2, the lateral tightening movement of the paper is effected by side cams 26, likewise fixed to the side walls 20, and acting via cam followers or rollers 27 mounted in the outer ends of the pipes 15. Respective pairs of pipes 15 are so biased opposite one another by the spring 28 that the movement thereof is in opposite directions, due to which a diagonal tightening or tensioning of the paper sheet occurs as represented by the arrows in FIG. 4. In FIG. 2, there are furthermore shown the keying or mounting against rotation of the suction levers 12 on the pipes 15 and of the forward or front sheet-guiding segments 8 on the shaft 10 of the cylinder, by means of pins 29 and 30, respectively.

Figure 3:
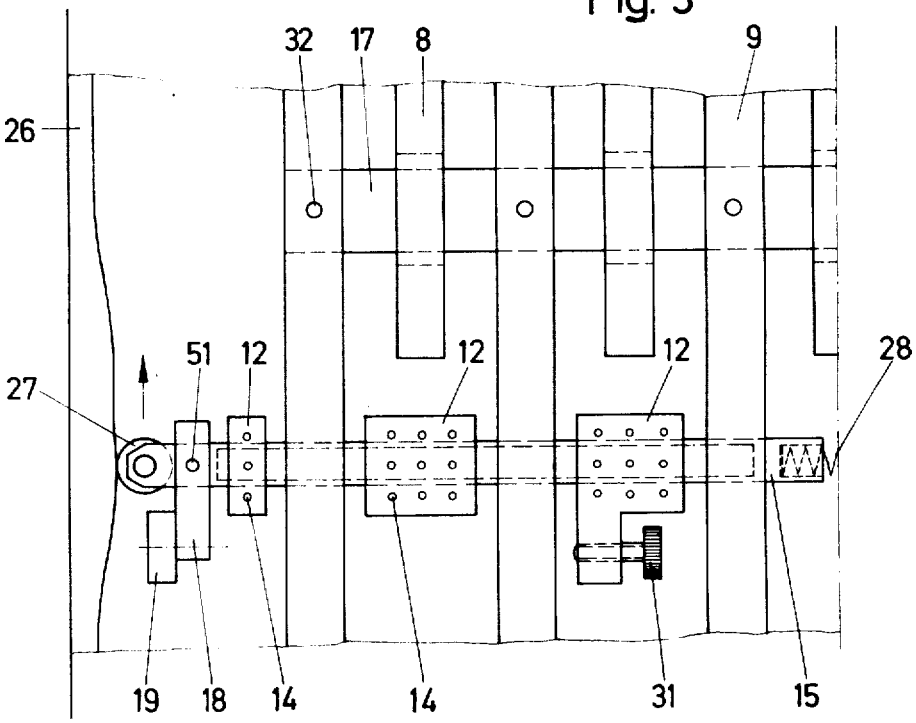
FIG. 3 is an enlarged fragmentary view of FIG. 2 as seen from the bottom thereof showing the suction openings in the suction levers, as well as the control device with a cam.

In FIG. 3, an enlarged fragmentary view of the suction device 11 is shown. By means of an adjustment screw 31, screwed into an arm on one of the suction levers 12, travel in lateral or axial direction for pulling the paper tight is able to be limited. This view, furthermore, clarifies the connection of the rear sheet-guiding segments 9 by means of the cross-piece 17 and the pins 32.

Figure 5:
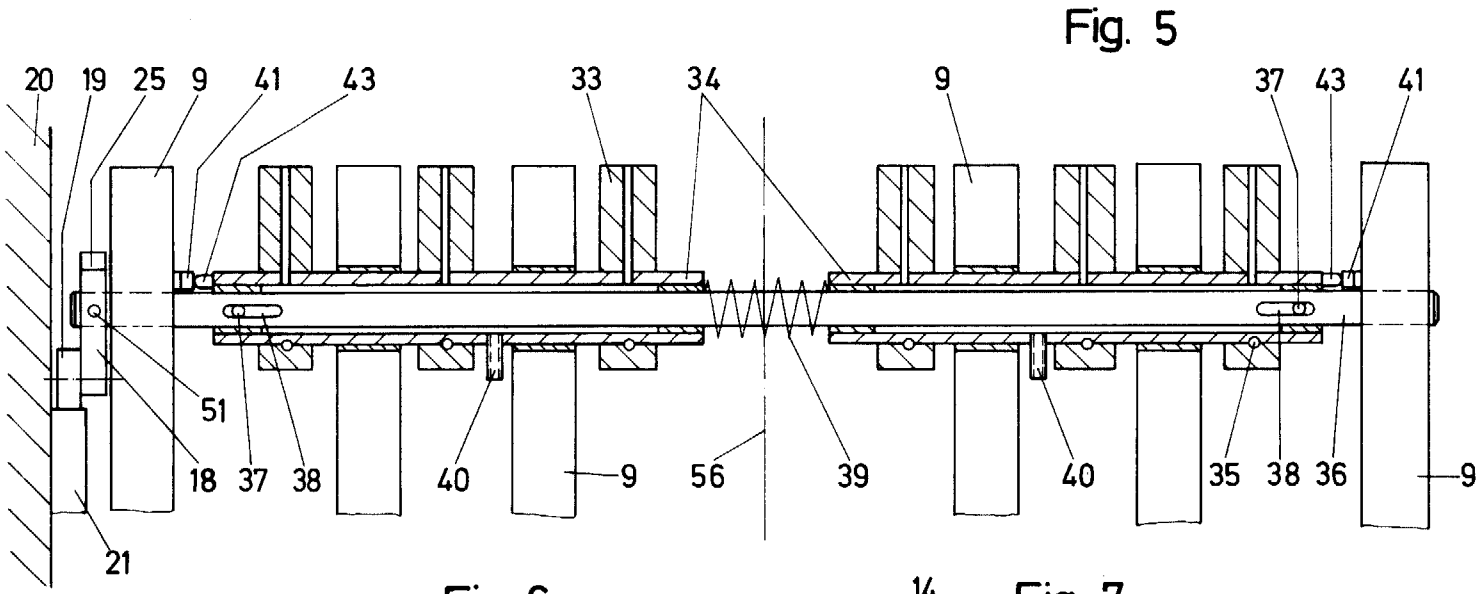
FIG. 5 is an enlarged fragmentary view of FIG. 2 showing a modification of the embodiment of the invention illustrated therein having a continuous shaft and only one cam for pulling the sheet tight circumferentially.

FIG. 5 illustrates a further possible way of mounting the suction levers 33 and the suction-air feed line. The suction levers 33 are keyed by pins 35 on two casing pipes 34, respectively, which, in turn, are themselves turnably mounted in the rear sheet-support segments 9. In the casing pipes 34, a rod 36 extending along the full length of the sheet-transfer cylinder 1 is mounted and is locked therewith so as to be secured against torsion relative thereto. This locking is effected by a respective straight pin 37 fixed in both of the casing pipes 34, each of the pins 37 being able to be moved in a corresponding slot 38 formed in the rod 36. The control of the circumferential sheet-tightening motion occurs, in this case, via only one spring loaded roller follower or lever 18 and acts by way of the rod 36 and the casing pipe 34 on the suction levers 33. The spring loading system in this case corresponds to that of the embodiment shown in FIG. 1. In the interest of clarity, it is not shown again in FIG. 5. The two casing pipes 34 are so biased opposite one another by a spring 39 that, due to the device for controlling the axial or lateral sheet-tightening or tensioning motion, motion of the suction levers 33 in opposite directions is produced.

Suction feed into the space between the casing pipe 34 and the rod 36 is effected via a respective suction connection or union 40.

Figure 6:
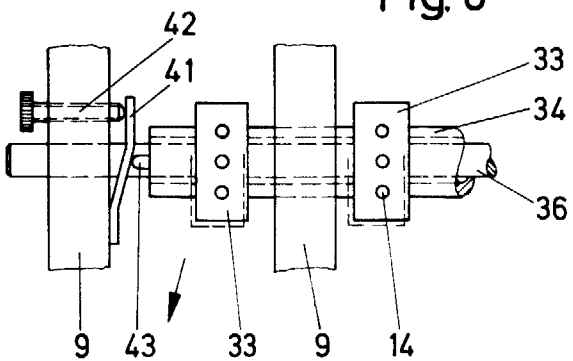
FIG. 6 is a fragmentary view of FIG. 5 as seen from above with the device for controlling axial or lateral sheet-tightening movement.

In FIG. 6, which is a fragmentary view of the structure of FIG. 5, rotated, however, through 90° with respect to the direction in which FIG. 5 is taken, the device for controlling the axial or lateral tensioning or tightening motion is represented.

On each of the two outer, rear sheet-guiding segments 9 there is a small cam plate 41, having an adjusting or spreading angle which is variable by an adjustment screw 42 relative to the rear sheet-guiding segment 9. During the turning of the casing pipe 34 for effecting the circumferential tightening or tensioning motion of the suction levers 33, the casing pipe 34 slides via a push rod 43, fixed at an end thereof, along the outer contour of the small cam plate 41 whereby lateral or axial tightening or tensioning motion is achieved. Therewith, the one tightening motion is produced directly from the other motion, yet due to the separate possibility of adjustment independent control is nevertheless possible.

Figure 7:
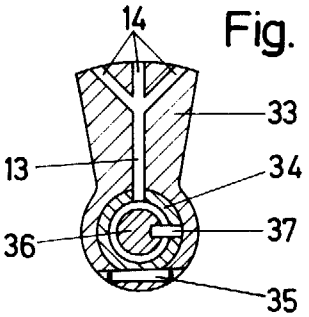
FIG. 7 is a fragmentary cross-sectional view of FIG. 5 showing a suction lever.

A sectional view of the suction lever 33 (FIG. 7) shows the disposition of the suction holes 13 and the suction channels 14 as well as the keyed locking of the suction lever 33 on casing pipe 34 by the aforementioned pin 35, and the keyed locking of the casing pipe 34, in turn, on the rod 36 by the pin 37.

Figure 8:
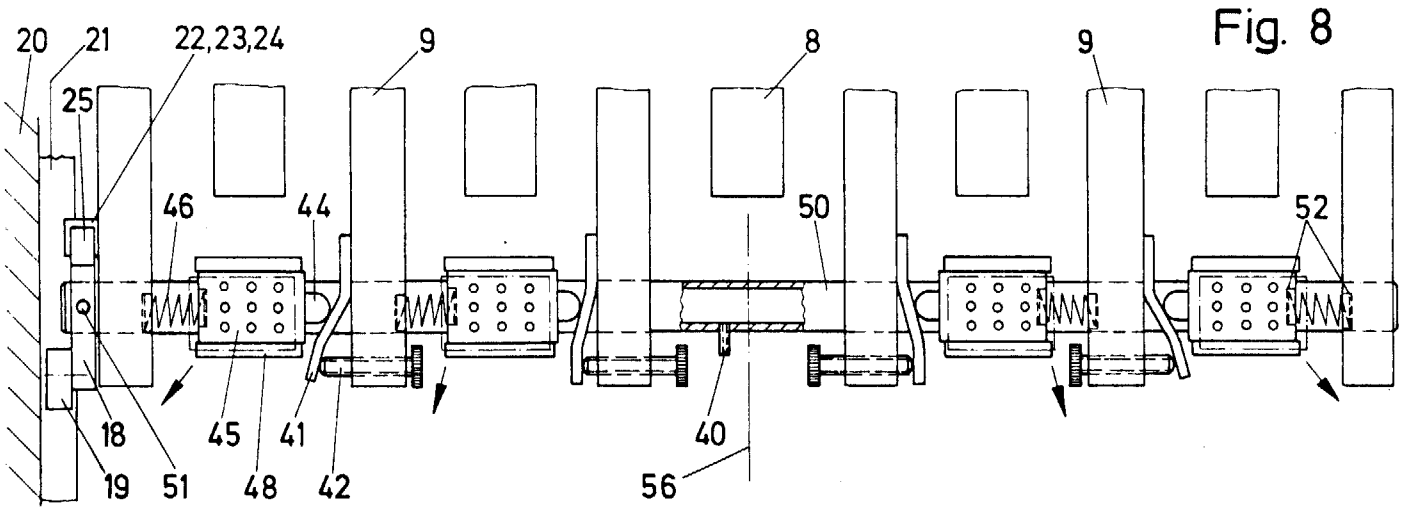
FIG. 8 is another view similar to that of FIG. 5 showing a further modification of the embodiment for axially pulling a sheet tight using individually shiftable suction plates on the suction levers.

One possible way of separately or individually controlling the axial or lateral tightening motion of each suction field or group of suction openings is shown in FIG. 8, wherein also as in the embodiment of FIGS. 5 and 6, the small cam plates 41 and adjustment screws 42 are again used. They cooperate with push rods 44, which are fixed to a respective end of suction plates 45. The latter are braced via compression springs 46 opposing sheet-guiding segments 9. The suction plates 45 themselves are longitudinally movably supported in corresponding recesses 47 formed in the suction levers 48 and thereby exchangeable as is apparent from FIGS. 9 and 10. The suction levers 48 are, in this respect, keyed by means of tapered pins 49 on a continuous pipe 50 which, for its part, is turnably mounted in the rear sheet-guiding segments 9 and is provided with the device for controlling the circumferential tightening motion.

Figure 9:
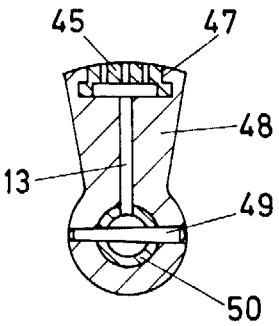
FIG. 9 is a cross-sectional view similar to that of FIG. 7 of a suction lever of FIG. 8 with a suction plate placed thereon.
Figure 10:
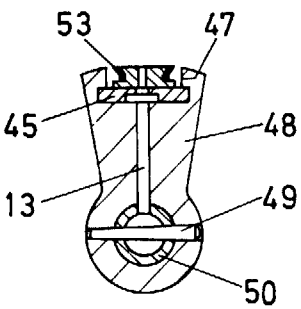
FIG. 10 is another cross-sectional view of the suction lever of FIG. 9, however, with a rubber suction foot or sucker on the suction plate placed thereon.
Figure 11:
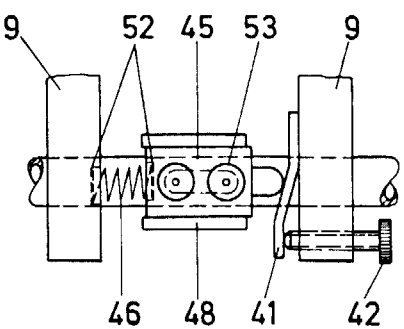
FIG. 11 is a plan view of the suction lever of FIG. 10.

A pin connection 51 between the roller levers or followers 18 and the pipe 50 permits the circumferential tightening motion to be transmitted to the suction levers 48. Depressions 52 machined into the suction plates 45 and the rear sheet-guiding segments 9 serve as reliable guides (FIG. 11) for the compression springs 46 during the circumferential tightening movement of the suction levers 48. Suction is supplied via a suction connection or union 40 into the interior of the pipe 50. The supply of vacuum or suction through the pipe 50, via a suction hole 13 in the suction lever 48, to the suction plates 45 is shown in FIGS. 9 and 10. Because of the exchangeability of the suction plates 45, it is possible to use different sorts of papers as well as different suction plates. A rubber suction foot or sucker 53, shown in FIG. 10, is especially suited for stiffer sorts of papers (cardboard). In this respect, a possible manner of disposing the rubber suction foot 53 as well as, again, of disposing the adjusting elements 41 and 42 acting upon the suction plate 45 is shown in FIG. 11.

Figure 12:
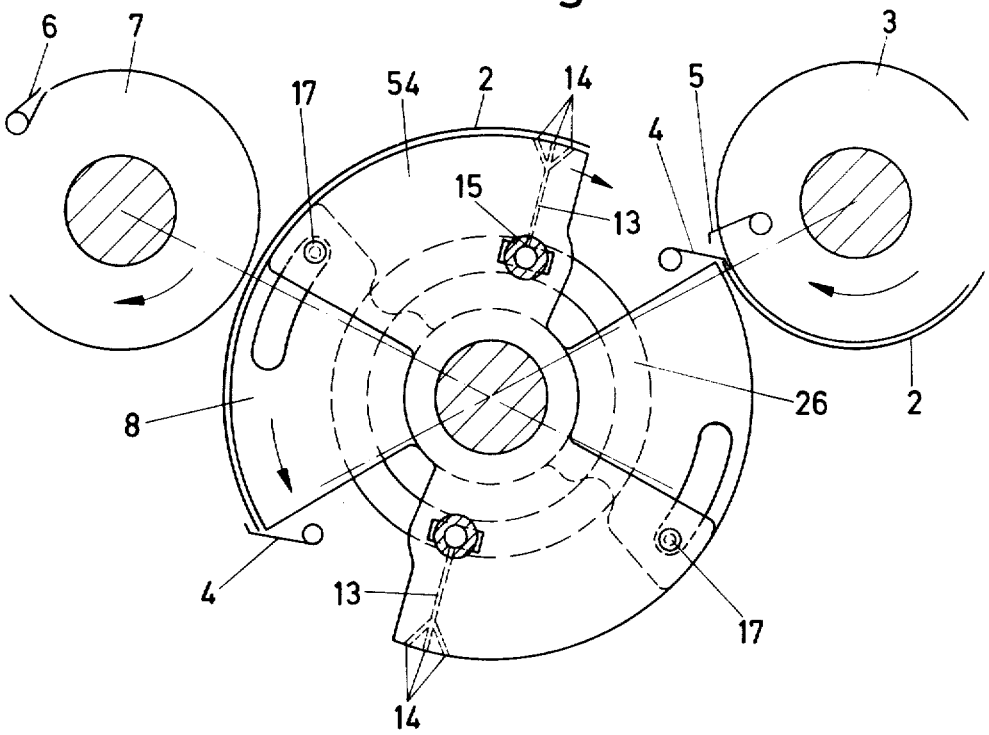
FIG. 12 is a view similar to that of FIG. 1 of another embodiment of a transfer cylinder according to the invention wherein suction holes are formed directly in the rear sheet guiding segments.
Figure 13:
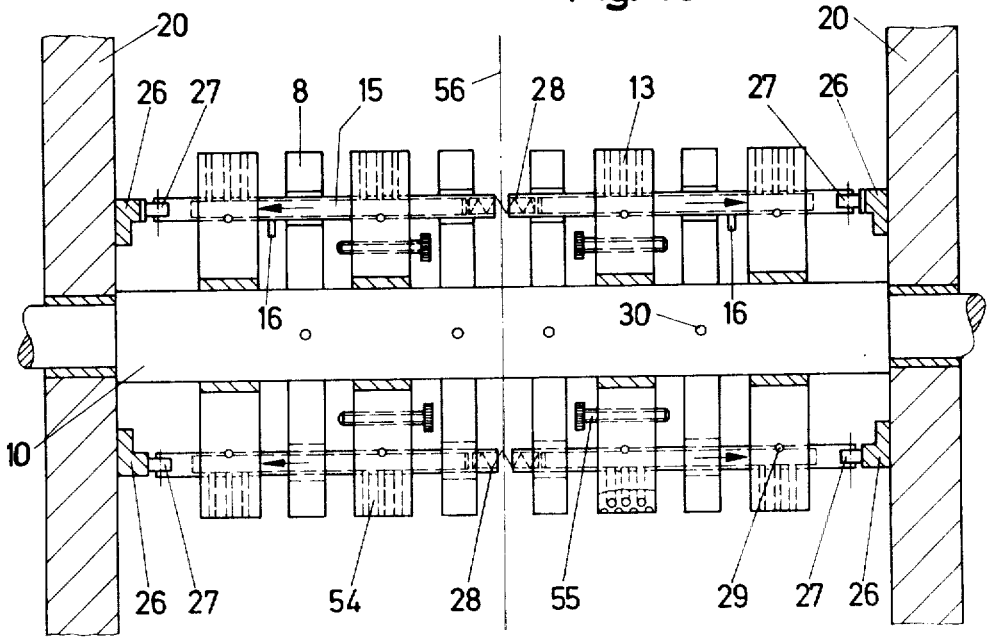
FIG. 13 is another view like that of FIG. 2 of the embodiment of FIG. 12 with the device for pulling the sheet tight axially or laterally.

A further embodiment of the sheet transfer cylinder is shown in FIGS. 12 and 13 wherein the rear, adjustable sheet-guiding segments 54 are joined together by two pipes 15, respectively, and directly provided with the suction holes 13 and the suction channels 14. The vacuum or suction supply is provided, via suitable connections or unions 16, through the pipes 15. The control of the circumferential swinging motion of the rear sheet-guiding segments 54 and, therewith, also of the suction device 11 may be effected, for example, as heretofore known in the prior art (see German Published Non-Prosecuted Application (DE-OS) No. 25 59 735 and is not illustrated in the interest of clarity. The further structural parts of the embodiment of FIGS. 12 and 13 are generally similar to those in the embodiment of the invention shown in FIGS. 1 to 3.

In FIG. 13, the disposition of the rear and front sheet-guiding segments 54 and 8, respectively, is shown more clearly, and likewise the control of the axial or lateral tightening motion. By means of adjustment screws 55, respectively fastened to the rear sheet-guiding segments 54, travel of the lateral or axial tightening movement can be limited with the front sheet-guiding segment 8 serving as a stop. In the embodiment of FIGS. 12 and 13, the radius of turning or swing of the suction device 11 corresponds to the radius of the sheet transfer cylinder 1, whereby deformation of the paper sheet during tightening and smoothing is completely avoided.

The possible solutions for controlling the axial or lateral tightening motion shown in FIGS. 5 to 11 as well as the different possible constructions of the corresponding structural parts described herein with regard thereto may be applied as well, with relatively slight constructive expense, to the embodiment of the sheet transfer cylinder according to FIGS. 12 and 13.

There is claimed:

1. Sheet transfer cylinder for a sheet-fed rotary printing machine convertible between first form and perfector printing having a gripper device for gripping the leading edge of a sheet and a suction device for gripping the trailing edge of the sheet and tightening and smoothing the sheet in travel direction thereof through the machine and transversely to the travel direction comprising first control means including at least one circumferential cam for controlling circumferential sheet-tightening movement, second control means including lateral cams for controlling lateral sheet-tightening movement, the suction device having parts thereof disposed side-by-side in axial direction of the cylinder and formed with suction holes, and transmission means operatively connecting said first and said second control means with said parts of said suction device so as to superimpose actions thereon for applying a diagonal tightening force to the sheet, said first and said second control means being independent of one another.

2. Sheet transfer cylinder according to claim 1 wherein said lateral sheet-tightening movement is over a given travel path, said travel path being adjustable.

3. Sheet transfer cylinder according to claim 1 wherein said suction device, comprises a plurality of suction units including said parts thereof, a plurality of said suction holes as well as suction channels being formed in each of said suction units.

4. Sheet transfer cylinder according to claim 3 including a shaft for the transfer cylinder whereon sheet supporting segments of the transfer cylinder are adjustably mounted, and further including pipes disposed parallel to said transfer cylinder shaft and turningly supported in respective rear segments of said sheet supporting segments, said suction unit parts including respective suction levers mounted side-by-side on said pipes, spring-loaded cam follower means cooperatively engaging said circumferential cam and actuatable thereby for imparting circumferential motion to said suction levers, and cam follower rollers secured to respective ends of said pipes and cooperatively engaging said lateral cams and actuatable thereby for imparting transverse tightening motion thereto, said lateral cams being fixed to side frame walls of the printing machine.

5. Sheet transfer cylinder according to claim 4 wherein the transfer cylinder has a middle transverse axis and including spring means disposed at said middle transverse axis between said pipes for biasing said pipes in mutually opposite directions and for moving the respective suction levers fixed to the respective pipes in opposite directions towards the closest-lying outer edge of the sheet transfer cylinder, the movement thereof being over a given travel path, and including adjustment screw means for adjusting said travel path.

6. Sheet transfer cylinder according to claim 3 including a rod extending over the entire length of the transfer cylinder, two casing pipes mounted on said rod coaxially thereto, said suction units including respective suction levers mounted on said casing pipes and fixed thereon against relative rotation therewith, said pipes, in turn, being fixed on said rod against relative rotation therewith but being axially displaceable relative thereto, said casing pipes being spring-biased so as to be axially displaceable in mutually opposite directions, and including adjustably mounted sheet supporting segments, respective rear segments thereof carrying respective cam plates disposed at an adjusting angle adjustable by adjusting screws, said casing pipes having respective push rods extending therefrom and slideable along said cam plates when being moved with circumferential swinging movement.

7. Sheet transfer cylinder according to claim 6 wherein said suction levers are circumferentially movable by said rod, and including spring-loaded roller follower means guidable on said circumferential cam, and key means for preventing relative torsion of said rod and said casing pipes.

8. Sheet transfer cylinder according to claim 3 including a pipe extending along the entire length of the transfer cylinder, said suction units including suction levers mounted on said pipe and fixed thereon against relative rotation therewith, said suction levers having respective upper regions engageable with a sheet to be pulled tight, respective suction plates disposed at said upper regions, respectively, said suction plates being longitudinally movable on said suction levers, respectively, and being exchangeable.

9. Sheet transfer cylinder according to claim 8 including cam plates disposed at an adjusting angle adjustable by adjusting screws, push-rod means engageable with said cam plates individually for acting directly upon the respective suction plates for controlling the lateral sheet-tightening movement with infinite adjustment.

10. Sheet transfer cylinder according to claim 3 including a plurality of adjustably mounted sheet supporting segments, said suction holes being formed directly in respective rear segments thereof, the outer radius of turning of said suction device corresponding to the radius of the sheet transfer cylinder, and including two suction supply pipes respectively connecting said plurality of sheet supporting segments.

* * * * *